United States Patent [19]

Constantinian

[11] Patent Number: 4,782,859

[45] Date of Patent: Nov. 8, 1988

[54] PRESSURIZED HYDRAULIC FLUID SPOOL VALVE

[75] Inventor: Krikor Constantinian, Bron, France

[73] Assignee: Rexroth-Sigma, Venissieux, France

[21] Appl. No.: 4,068

[22] Filed: Jan. 16, 1987

[30] Foreign Application Priority Data

Jan. 17, 1986 [FR] France ..... 86 00632

[51] Int. Cl.[4] ..... F15B 13/08

[52] U.S. Cl. ..... 137/596.2; 91/446; 91/447; 91/464; 137/596.13; 137/625.68

[58] Field of Search ..... 91/446, 447, 464; 137/596.13, 625.68, 596.2

[56] References Cited

U.S. PATENT DOCUMENTS 3,742,982 7/1973 Miller ..... 137/625.68

4,352,375 10/1982 Williams ..... 137/596.13

4,570,671 2/1986 Constantinian ..... 137/596.13 X 4,649,951 3/1987 Tardy ..... 137/596.13

*Primary Examiner*—Gerald A. Michalsky

*Attorney, Agent, or Firm*—Larson and Taylor

[57] ABSTRACT

The invention relates to a pressurized hydraulic fluid spool valve intended to be stacked against other similar spool valves, having a valve body (1) with a spool (4) adapted for sliding in a bore (5) into which open in the following order: a first intake recess (19) in a central position, two second recesses (21A, 21B) for connection to a hydraulic apparatus situated on each side of the preceding one; two third recesses ($T_1$, $T_2$) situated respectively beyond the second recesses, and two fourth recesses ($22_1$, $22_2$) situated respectively beyond the third recesses.

8 Claims, 5 Drawing Sheets

PRESSURIZED HYDRAULIC FLUID SPOOL VALVE

The present invention relates to improvements to pressurized hydraulic fluid spool valves, intended to be stacked against other similar spool valves, including a valve body with at least one pressurized fluid intake port, at least one port for returning fluid to a reservoir, two ports for connection to a hydraulic apparatus or component, and a spool adapted for sliding in a bore of the valve body, the body and the spool including passages and/or ducts and/or grooves adapted so as to cooperate for forming the desired connections or closures of the different ports of the valve body depending on the position occupied by the spool among at least three possible positions, namely a direct position, a neutral position and a reverse position, and possibly a fourth position or indeterminate position, the body further comprising a transverse channel extending from one face of the body of the valve serving as bearing face in the stacking, to another parallel face, this channel being combined with at least one pressure selector for transmitting downstream the highest of two pressures formed respectively by the pressure upstream of the channel and a working pressure of the valve.

Hydraulic spool valves of the type described are well known in the state of the art. Howver, their arrangements are such that they do not lend themselves well to constructional diversification, that is to say to the addition of auxiliary devices to a basic structure without being forced to design specific bodies for each construction and so without it being possible to have standardization which is useful, even necessary, for facilitating the side by side association, or stacking, of several spool valves so as to form a complex hydraulic control box. Furthermore, because of this diversification of construction, the manufacturing costs are high and the maintenance of stocks is complicated thereby.

The aim of the invention is essentially to overcome these drawbacks of prior hydraulic spool valves and to provide a valve structure which better satisfies the different requirements of practice, particularly by providing a spool valve structure lending itself to the formation of different embodiments from the same basic body, or at least to the formation of different embodiments having main dimensions and compatible implantations allowing ready stacking of several spool valves and, in any case, by providing arrangements which substantially reduce the manufacturing costs and the number of spare parts to be kept in stock, whence also a reduction of maintenance costs.

For this, a spool valve is provided adapted in accordance with the invention which is characterized by the combination of the following arrangements:

the intake port for the pressurized fluid is connected to a first recess of the bore substantially in the central region thereof;

the two ports for connection to a hydraulic apparatus or component are connected respectively to two second recesses of the bore situated on each side of the first recess;

the fluid return port is connected to two third recesses of the bores situated respectively beyond said second recesses, with respect to the first recess;

the above mentioned channel is connected to two fourth recesses of the bore situated respectively towards the ends of said bore, beyond said third recesses, with respect to the first recess;

the spool includes two annular grooves or zones of reduced diameter, situated approximately opposite the second recesses when the spool is in the neutral position;

the two end zones of the spool situated beyond the two annular grooves respectively, are pierced respectively with two axial passages opening into the lateral surface of the spool respectively through two radial passages situated approximately opposite the third recesses when the spool is in the neutral position;

at least one bore is provided in the spool valve body, for providing communication between one of the end axial passages of the spool and the corresponding third recess of the bore;

two radial passages or similar are formed respectively in the two end zones of the spool approximately opposite the fourth recesses respectively, when the spool is in the neutral position;

finally, the sliding spool belongs to one of the two following types:

(a) in a first type of spool, the grooves of the spool have a bottom without flange, the valve equipped with such a spool having three functional positions, namely direct, neutral and reverse;

(b) in a second type of spool, one of the grooves of the spool has a flange situated approximately centrally and having peripherally the nominal diameter of the spool, the valve equipped with such a spool having four functional positions, namely direct, neutral, reverse and indeterminate.

The arrangement which has just been described forms the basic structure which, using the same valve body, allows a three position or four position spool valve to be obtained by an appropriate choice of the spool: the provision of a fourth indeterminate position is effected without extending the valve body, which was not possible with the arrangements used up to now for prior art valves. The valve body, a complex part difficult to manufacture and so costly, may thus be produced in much greater numbers and the amortizement of the tools required is quicker; furthermore, from the maintenance point of view, the holding of stocks is simplified resulting in a reduction of maintenance costs.

In the preferred embodiment, the two connection ports are situated on the same face of the valve (or first main face) other than the two above mentioned bearing faces in the stack and other than the two end faces between which said bore extends; the two corresponding ducts connecting the ports with the two second recesses, respectively extend through the portion of the body of the valve situated between said first main face and the bore and the intake port; and the corresponding ducts connecting this latter to said first recess, are situated in the portion of the body of the valve situated between the bore and the second main face opposite the first above mentioned main face.

Thus, a geographical separation is made of the main ports within the hydraulic spool valve which is only made possible because of the succession in the above order of the different recesses through which passes the bore in which the spool moves. There is thus available, particularly in the vicinity of the connection port and the intake ports, a free volume allowing auxiliary members to be incorporated in the body of the valve without an increase of the majority of the main dimenstions of the body and, in any case, while keeping the same dimensions between end faces and between bearing faces for the stacking.

Thus, in a first example, in a portion of the valve body containing the intake port, a hydraulic balance arrangement known per se is provided: thus a hydraulic spool valve is provided with balance, having three or four positions of the spool, able to be stacked with a spool valve of one of the two above mentioned basic types.

Thus, in a second example, one at least of the connection ports is provided with a mechanically controlled non return valve: thus a hydraulic distributor is obtained equipped with one or two mechanically controlled non return valves, with or without balance, having three or four positions of the spool.

Thus, in a third example, one at least of the connection ports is provided with a hydraulically controlled non return valve: thus a hydraulic distributor is obtained equipped with one or two hydraulic controlled non return valves, with or without balance, having three or four positions of the spool.

In the second and third examples, the mechanically or hydraulically controlled non return valve and its control means are disposed in the portion of the valve body situated between the bore and the first main face of the valve body: the main dimensions of the valve body may thus be kept, and it is possible to stack a spool valve thus formed with one or other of the above mentioned spool valves of the invention, so as to form hydraulic control boxes grouping together, without any assembly or dimensional problems, spool valves fulfilling different functions.

The invention will be better understood from reading the detailed description which follows of some of its embodiments, given solely by way of illustration without any limitative character. In this description, reference is made to the accompanying drawings in which.

Figure 7:
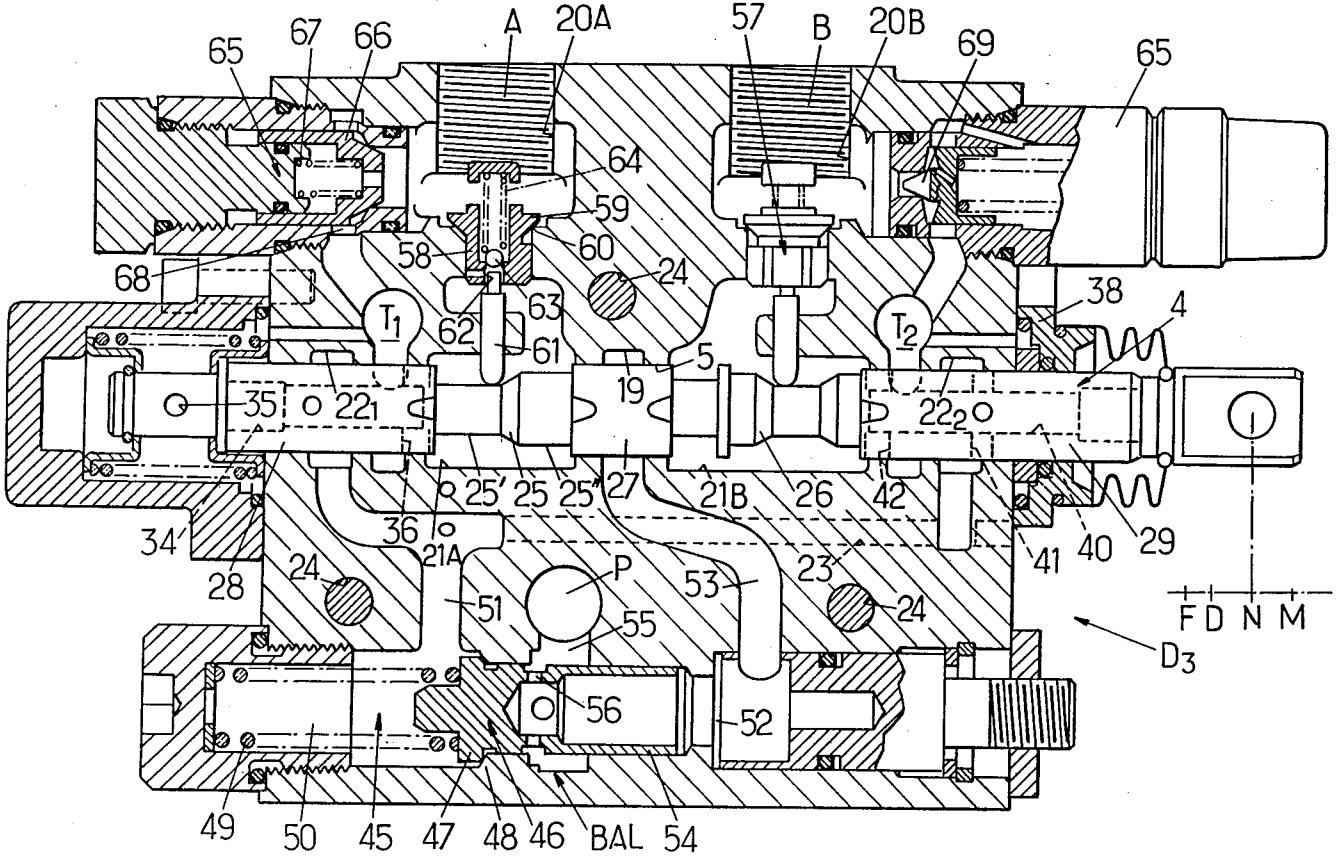
Figure 8:
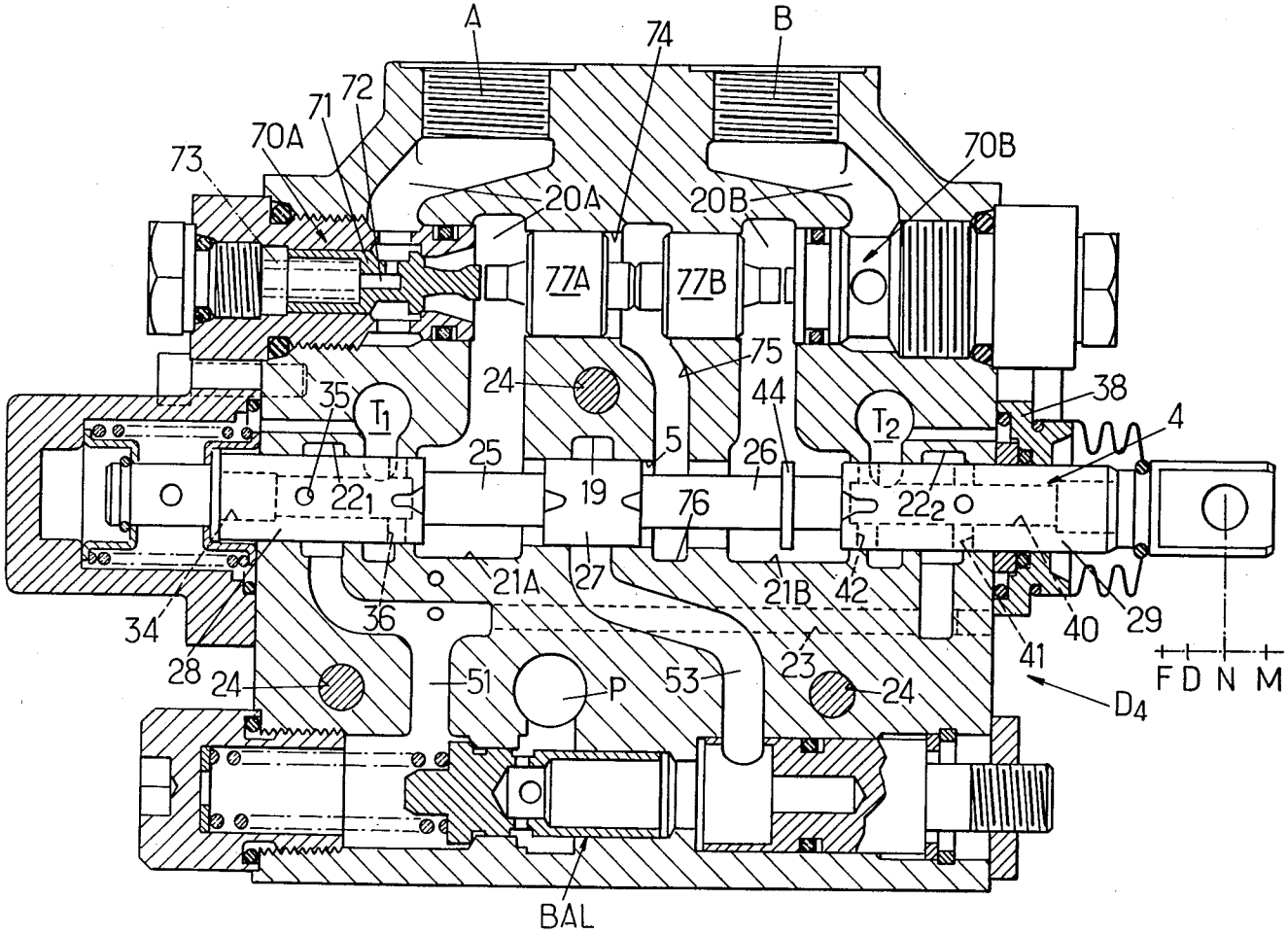

FIG. 7 is a longitudinal sectional view of a four position spool valve, whose connection ports are provided respectively with two mechanically controlled non return valves, with hydraulic balance, the spool being in the neutral position; and FIG. 8 is a longitudinal sectional view of a four position spool valve, whose connection ports are provided respectively with two hydraulically controlled non return valves, with hydraulic balance, the spool being in the neutral position.

Referring first of all to FIGS. 1 to 4, the spool valve $D_1$ includes a body 1 having a port P for intake of the pressurized fluid (in the form of a channel passing through body 1 and opening into one of the two faces 2 and 3 of said body serving as bearing face for the side by stacking of several spool valves), at least one port T (not shown in the Figures) for return of the fluid to a reservoir (not shown), two orifices A, B for connection to a hydraulic apparatus or component (not shown), and a spool 4 adapted for sliding in a bore 5 of body 1; the bore 5 passes longitudinally through body 1 and opens in two opposite faces, or end faces 6, 7 thereof. Conventionally body 1 and spool 4 include passages and/or ducts and/or grooves adapted so as to cooperate for establishing the desired connections or closures of the different ports of the body of the spool valve depending on the position occupied by the spool. The arrangements of these passages and/or ducts and/or grooves specific to the invention will be discussed further on.

Furthermore, body 1 includes a transverse channel 8 extending between the bearing faces 3 and 4 and combined with at least one pressure selector S for transmitting downstream the highest of two pressures formed respectively by the pressure upstream of the channel and a working pressure of the spool valve. At each end, channel 8 opens into a cavity formed in the corresponding face of the body, namely cavity 9 in face 2 and cavity 10 in face 3. The positioning of the cavities in the bearing faces 2 and 3 is such that, when two spool valves are stacked together, the cavity 9 of one and the cavity 10 of the other cooperate so as to form a chamber in which is housed a valving means 11, in the form of a cylinder, adapted for closing as required the orifice of which a second channel 12 opens into the cavity 10. For details of the construction operation of the selector S, reference may be had to the patent application FR 2 540 214.

Furthermore, port P may be followed by a chamber 13 housing a non return valve 14 urged onto its seat by a calibrated spring 15. In the rest of the description, reference will be made to two portions of the body 1 of the spool, namely the portion of the body situated between bore 5 and one of the main faces of the body 1 which is neither an end face nor a bearing face (face 16 situated at the top of FIG. 1), and hereafter designated portion $1_s$ (considering FIG. 1), and the portion of the body situated between the bore 5 and the face 17 opposite face 16 (at the bottom of FIG. 1), and designated hereafter lower portion $1_i$ (considering FIG. 1).

In the lower portion $1_i$ of body 1 is situated the intake through port or channel P, the chamber 13 and the non return valve 14 which are associated therewith, as well as a duct 18 which connects the output of the non return valve to a first recess 19, situated axially approximately in the central zone of bore 5 and having a transverse dimension greater than the diameter of bore 5.

The connection ports A and B both open into the main face 16 (situated at the top of FIG. 1), and are connected through ducts 20*a* and 20*b*, respectively, passing through the upper portion 1 of body 1, with second recesses 21A and 21B, situated on each side of the first recess 19.

Beyond the second recesses 21A and 21B, in the direction of the end faces 5 and 6, are provided respectively two second recesses connected, in a way not visible in FIGS. 1 to 4, to the port T for the return of fluid to the reservoir; for the sake of simplicity, these third recesses will be designated by $T_1$ for the one close to the second recess 21A and by $T_2$ for the one close to the second recess 21B. Finally, beyond the two third recesses $T_1$ and $T_2$ in the direction of the end faces 5 and 6, are provided two fourth recesses $22_1$ and $22_2$, respectively, forming part of a hydraulic load sensing circuit. The two recesses $22_1$ and $22_2$ are joined together by a channel 23 extending through the lower portion $1_i$ of body 1 and into which the channel 12 of selector S opens.

Considering the arrangements which have just been discussed, it can be seen that the lower portion $1_i$ of body 1 contains all the parts and ducts relative to the intake of the pressurized hydraulic fluid, as well as the ducts relative to the load sensing circuit, whereas the upper part $1_s$ of body 1 only contains the ducts 20A and 20B connecting the connection ports A and B with the corresponding recesses 21A and 21B: thus, within the upper portion $1_s$ of body 1, a free volume is available sufficient for adding different auxiliary members as will be described further on.

In the configuration which has just been mentioned, the different recesses 19, 21A, 21B, $T_1$, $T_2$, $22_1$ and $22_2$ are therefore mutually aligned and are traversed by the bore 5.

Finally, the body 1 of the spool valve has holes 24 passing therethrough which open into its two bearing faces 2 and 3 which still have the same geographical location whatever the type of valve and which are intended to have assembly tie rods passing therethrough for mechanically connecting several spool valves together so as to form a hydraulic control box.

The spool 4 is formed by a member having a generally cylindrical form of revolution mounted for sliding in bore 5.

Figure 1:
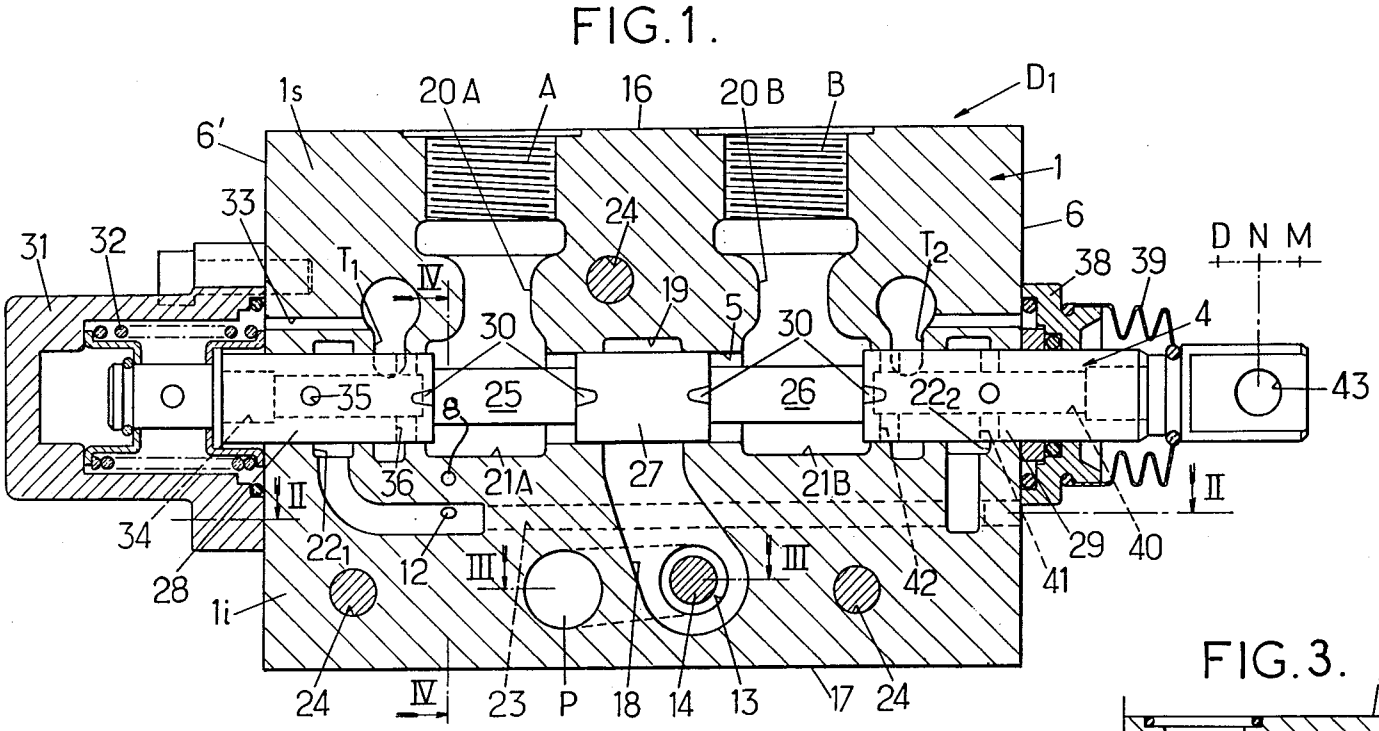
FIG. 1 is a longitudinal sectional view of a three position spool valve adapted in accordance with the invention, the spool being shown in the neutral position.
Figure 3:
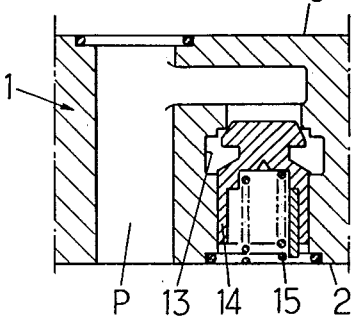
FIGS. 2 to 4 are fragmentary sectional views along lines II—II, III—III and IV—IV respectively of FIG. 1.
Figure 2:
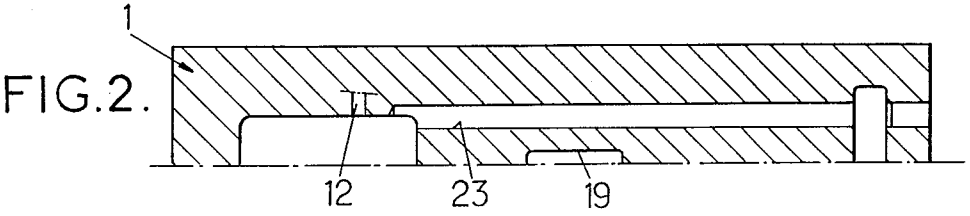
Figure 4:
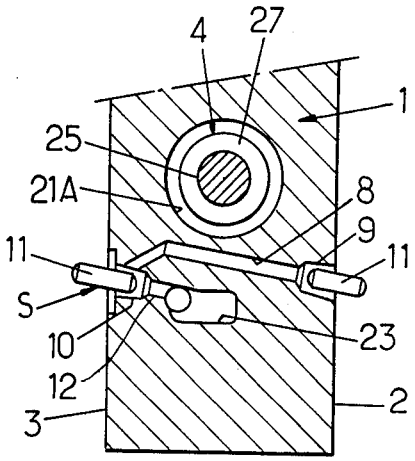

Spool 4 is recessed with a smaller diameter in two zones or grooves 25 and 26, spaced axially apart from each other and situated approximately in line with the second recesses 21A and 22A, respectively, when the spool 4 is in the neutral position as shown in FIG. 1. In other words, these two grooves 25 and 26 separate three zones having the nominal diameter of the spool, namely a central zone 27 situated approximately opposite the first recess 19 and two end zones 28 and 29, respectively towards the end faces 5 and 6, situated approximately opposite the third and fourth recesses and beyond (in the neutral position of the spool shown in FIG. 1). Progressive increase slots 30 are provided in a way known per se at the ends of zones 27, 28 and 29 so as to eliminate the shocks and improve the progressive increase of the control.

A cap 31 fixed to the end face 5 of body 1 covers the projecting end of spool 4 and houses more particularly a spring 32 for urging the spool to the neutral position. The inner volume of this cap 31 is connected, through a channel 33 pierced in the upper region $1_s$ of body 1, to the third recess $T_1$.

At the same end, the spool 4 is formed with an axial channel 34 extending longitudinally over substantially the length of the end zone 28. To this axial channel 34 are connected a first radial channel 35 situated approximately at the level of the fourth recess $22_1$ and a second radial channel 36 situated approximately at the level of the third recess $T_1$.

For reasons of symmetry and so as to facilitate certain assembly configurations, the third recess $T_2$ also communicates with a channel 32 opening into the end face 6, without however, in the example shown, this communication being operational considering the associated arrangements adopted.

The corresponding end of spool 4 projects from bore 5 and sealing is provided by means of an annular sealing device 38 bearing against the end face 6 of body 1, connected to the end of the end zone 28 by a sealed bellows 39.

At this same end, spool 4 is formed with an axial channel 40 extending longitudinally over substantially the length of the end zone 29. To this axial channel 40 are connected a first radial channel 41 situated approximately at the level of the fourth recess $22_2$ and a second radial channel 42 situated approximately at the level of the third recess $T_2$. It will be noted that the second radial channel 42, as well moreover as the second radial channel 36 as mentioned above, may each be formed by one or more radial orifices situated preferably in the same radial plane.

The free end of spool 4 is formed with a hole 43 for fixing this spool to an appropriate actuation means (not shown). The letters N, D and M shows the axial position of the center of this hole 43 when the spool 4 is respectively in the neutral position or in a functional endmost position.

The operation of the spool valve $D_1$ which has just been described is as follows.

In the neutral position of the spool (position N at the center of hole 43) shown in FIG. 1, the central zone 27 of the spool completely closes the first recess 19, the end zone 28 completely closes a third and fourth recess $T_1$ and $22_1$, whereas the end zone 29 completely closes the third and fourth recesses $T_2$ and $22_2$: no communication is possible between the intake port P and one of the connection ports A or B nor between the other connection ports respectively B or A and the return port T.

Because the radial channels 35, 36, 41 and 42 are, at least partially, facing the corresponding recesses, the load sensing circuit (duct 23) is connected to the return port T via the axial channels 34 and 40 of the spool. Selector S is then in the closed position.

Figure 5:
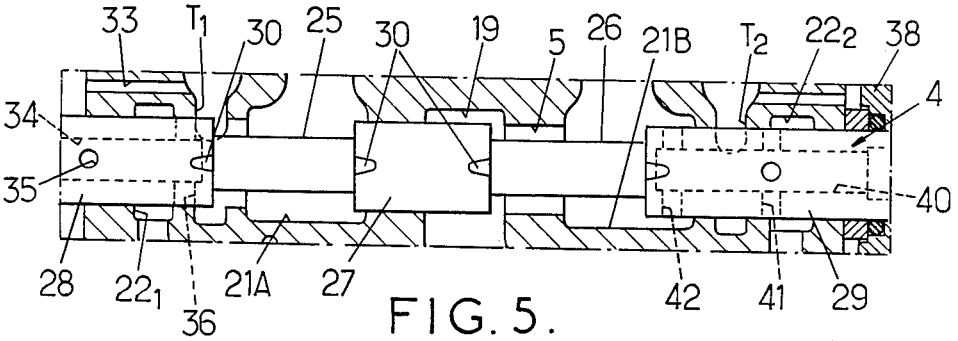
FIG. 5 is a longitudinal sectional view of the spool valve of FIG. 1 with the spool shown in another functional position.

If the spool is moved from its neutral position, for example leftwards in FIG. 5 (position D), the central zone 27 isolates the recesses 21A and 19, whereas groove 26 overlaps the recesses 19 and 21B and groove 25 overlaps the recesses $T_1$ and 21A. In other words, communication is established between ports P and B, on the one hand, and between ports A and T on the other.

In addition, in this position, the radial channels 35 and 36 are closed, whereas the radial channel 42 35 and 36 are closed, whereas the radial channel 42 communicates with the recess 21B and the radial channel 41 with recess $22_2$. The load sensing circuit (duct 23) receives then the pressure applied to the load, which is applied to the selector S whose closure member 11 is positioned so as to transmit upstream the highest pressure of the two pressures to which it is subjected.

Similarly, the spool moved towards position M (to the right in the Figures) would establish communication between ports P and A, on the one hand, and communication between ports B and T, on the other, with transmission of the pressure applied to the load to the load sensing circuit through the radial channel 36 in communication with recess 21A, of the axial channel 34 and of the radial channel 35 in communication at least partially with recess $22_1$.

Figure 6:
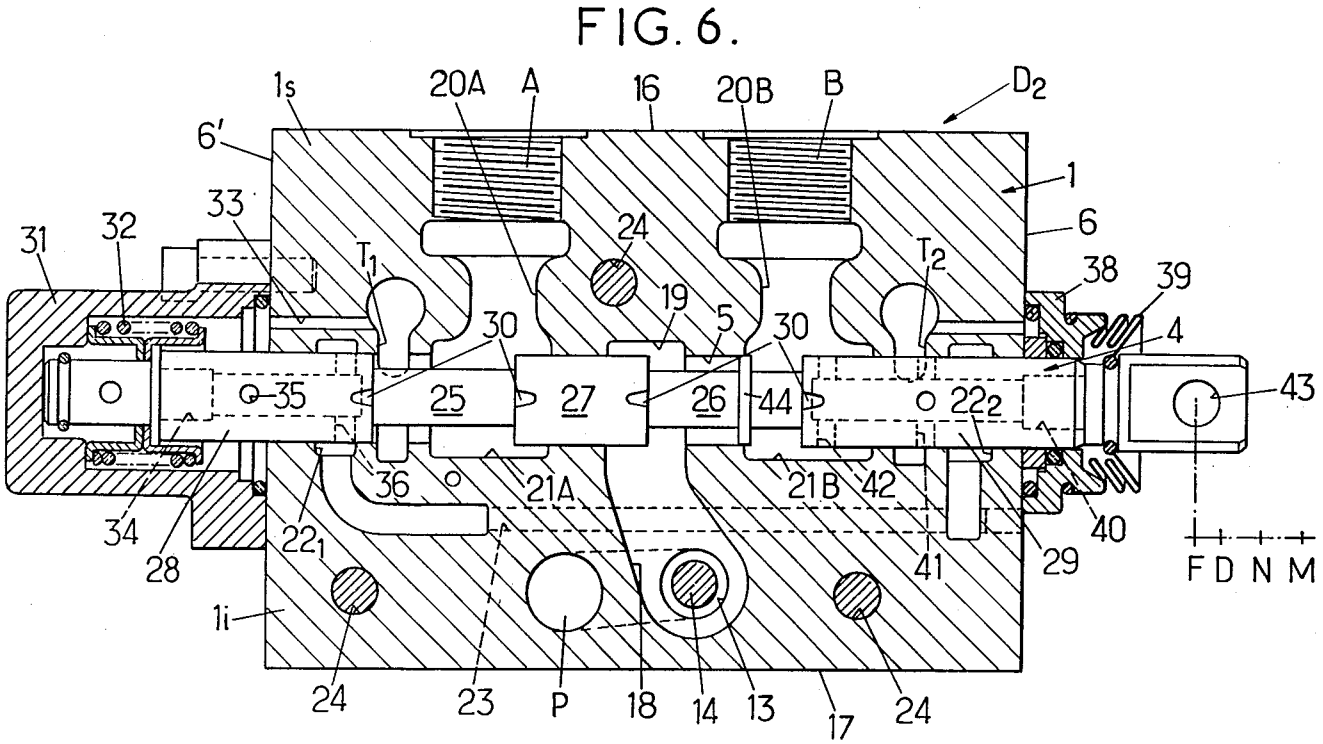
FIG. 6 is a longitudinal sectional view of a four position spool valve adapted in accordance with the invention, the spool being disposed in the indeterminate position.

FIG. 6 shows a four position spool valve $D_2$. The structure of the spool valve $D_2$, is identical to that of the spool valve $D_1$ of FIGS. 1 to 4 (and the same numerical references are kept for designating the same elements in FIG. 6), except that a flange 44, of the same nominal diameter as zones 27, 28 and 29 of the spool, is situated approximately in the central region of the groove 26.

The operation of spool valve $D_2$ is identical to that of spool valve $D_1$ in so far as the three positions N, D and M are concerned.

Besides these three positions, the spool valve $D_2$ of FIG. 6 may occupy a fourth position F, or indeterminate position, situated to the left of position D. It is in this position F that the spool valve $D_2$ is shown in FIG. 6. In this position, the central zone 27 of the spool isolates recesses 21A and 19 and the flange 44 isolates recesses 19 and 21B: no flow from P to A or to B is then possible. On the other hand, ports A and T are joined together by the groove 25 causing recesses $T_1$ and 21*a* to communicate, whereas ports B and T are joined together by the radial channel 42 the axial channel 40 and the radial channel 41 causing the recesses B and $T_2$ to communicate. The load sensing circuit (duct 23) is then connected to port T because the radial channel 35 is in communication with the inner volume of cap 31, itself connected to the recess $T_1$ via duct 33.

Through the arrangement which has just been described for the spool valves adapted in accordance with the invention, not only is it possible to form three or four position valves using the same body 1 in both cases and spools only having a minimum structural difference with respect to each other, allowing the use of the same manufacturing tools, but it is also possible, considering the free volume available within the body, to add certain functions without increasing the dimensions of the body, at least in so far as the distance is concerned between its end faces 5 and 6 and between its bearing faces 2 and 3 in the stacks.

Thus, for example, it is possible to add a hydraulic balance in place of the non return valve 13, 14 of spool valves $D_1$ and $D_2$. In FIG. 7, a spool valve $D_3$ has been shown equipped with such a balance BAL, known per se, situated in the lower portion $1_i$ of body 1 which is slightly enlarged for this purpose (downwards in FIG. 7) without prejudice for the aptitude of the spool valve $D_3$ to be incorporated in a stack.

To this end, in the lower portion $I_i$ is provided an elongate chamber 45 for example with its axis parallel to bore 5. Inside chamber 45 is disposed a mobile non return valve 46 held, by a collar 47 which it comprises, against a seat 48 under the action of a calibrated spring 49. Seat 48 divides chamber 45 into two parts: a chamber part 50 (to the left of the seat in FIG. 7) housing the spring 49 is in communication with duct 23 of the load sensing circuit through a connecting channel 51: a chamber part 52 (on the right of the seat in FIG. 7) is in communication with a first recess 19 through a duct 53. Furthermore, non return valve 46 has a cylindrical shank 54, engaged in the chamber part 52 which plays the role of mobile closure means for the orifice facing a connection 55 with port P. A radial bore 56 places the external surface of shank 54 in communication with an internal bore open towards the chamber part 52.

The operation of the spool valve $D_3$ adapted in accordance with the invention and equipped with a hydraulic balance can be understood by a man skilled in the art and will not be further described.

It is also possible, considering the empty volume available in the upper portion $1_s$ of body 1, to add to the ports A and/or B mechanically or hydraulically controlled non return valves.

In FIG. 7, the spool valve $D_3$ is equipped with two mechanically controlled non return valves, known per se, associated respectively with the connection ports A and B.

If we consider for example port A, its duct 20A is adapted to retain a mechanically controlled non return valve 57 whose body 58 bears, by a flange 59, on a seat 60 of body 1. A finger 61, slidingly retained in body 1, has its free end which cooperates with the bottom of the groove 25 of spool 4, which plays the role of a linear cam with variable profile (its left hand portion 25' has a transverse dimension smaller than that of its right hand portion 25''). The opposite end of finger 61 is engaged in a channel 62 of the body 58 of the non return valve 57 and may cooperate with a ball 63 closing the orifice of this channel, while being urged back by a calibrated spring 64.

Furthermore, it is also possible to provide a resupply valve 65—known per se—which includes a mobile closure means 66 movable against the force exerted by a calibrated spring 67 for progressively uncovering an orifice 68 communicating with $T_1$, which re-supply valve 65 is shown on the left of FIG. 7, between duct 20A (in its zone situated between port A and valve 57) and the recess $T_1$). Similarly, it is also possible to provide a secondary pressure limiting valve 69—known per se—which is shown on the right of FIG. 7 in association with port B.

The mode of operation of spool valve $D_3$, adapted in accordance with the invention and equipped with one or two valves 57, and possibly with a re-supply valve 65 and a secondary pressure limiting valve, will be readily understood by a man skilled in the art and will not be described further.

Similarly, to the preceding case, it is possible to add to the connection ports A and/or B hydraulically controlled non return valves respectively 70A, 70B, known per se, as shown in FIG. 8 for spool valve $D_4$. If we consider for example the port A, the duct 20a which is associated therewith is adapted so as to house a hydraulically controlled valve 70A whose mobile member 71 is provided with an axial bore 72 in communication both with the rear of the housing of member 71 and with port A; the mobile member is, in the absence of antagonistic forces, urged against its seat by a return spring 73. The hydraulically controlled valve 70B has the same arrangement, and the two valves 70A and 70B are coaxial, parallel to the bore 5 of spool 4.

Ducts 20A and 20B are, in their respective parts in communication with the second recesses 21A and 21B, connected together by a bore 74 substantially parallel to bore 5 and coaxial with the housings of valves 70A and 70B. The substantially median part of bore 74 is connected, through a duct 75, to a recess 76 of bore 5 situated between recesses 19 and 21B. In the sections of bore 74 situated on each side of duct 75 are disposed respectively two pistons 77A and 77B.

When spool 4 is in the neutral position N (as shown in FIG. 8), the two valves 70A and 70B are held closed by the return spring 73 and possibly by the pressure present at port A transmitted through duct 72 to the rear face of the mobile member 71 of the valve.

When the spool is moved rightwards (in FIG. 8), to position M, the supply pressure present in duct 53 is transmitted to duct 20A and provides opening of valve 70A. In the absence of pressure at port B and in duct 75, the pressure in duct 20A moves the piston 77A and 77B rightwards, which causes valve 70B to open. The communications between ports P and A on the one hand and between ports B and $T_2$ on the other, are thus established.

When spool 4 is moved leftwards (in FIG. 8) to position D, the supply pressure present in duct 53 is transmitted to duct 75 and to duct 20B. The result is, under conditions similar to what was mentioned above, the opening of valve 70B and, by movement leftwards of piston 77A and 77B, the opening of valve 70A. The communications between ports P and B on the one hand and between ports A and $T_1$ on the other are thus established.

When spool 4 is moved to the extreme left position (in FIG. 8), indeterminate position, the supply pressure present in duct 53 is transmitted solely to duct 75 and urges back the two pistons 77A and 77B away from each other while thus causing opening of the two valves 70A and 70B. The communications between ports A and $T_1$ on the one hand and between ports B and $T_2$ on the other are thus established.

In any case, the arrangement and operation of the hydraulically controlled valves are well known to a man skilled in the art.

It may be noted that, whatever the embodiment considered, cap 31 may further enclose a mechanical locking member (not shown) which mechanically locks the spool 4 in the functional positions.

As is evident and as it follows moreover already from what has gone before the invention is in no wise limited to those of its modes of application and embodiments which have been more especially considered; it embraces, on the contrary, all variants thereof.

I claim:

1. A pressurized hydraulic fluid spool valve, intended to be stacked against other similar spool valves, including a valve body (1) having at least one intake port (P) for the pressurized fluid, at least one return port (T) for returning the fluid to a reservoir, two connection ports (A, B) for connection to a hydraulic apparatus, and a spool (4) adapted for sliding in a bore (5) of the spool valve body (1), the body (1) and the spool (4) having passages adapted so as to cooperate for establishing the desired connections or closures of the different ports of the body of the spool valve depending on the position occupied by the spool among at least three possible positions, namely a direct position (D), a neutral position (N) and a reverse position (M), the body (1) further having a transverse channel (8) extending from one face (2) of the body of the spool valve intended to serve as bearing face in the stack, to another parallel face (3), this channel (8) being combined with at least one pressure selector (S) for transmitting downstream the highest of the two pressures formed respectively by the pressure upstream of the channel and a working pressure of the spool valve, the intake port (P) for the pressurized fluid being connected to a first recess (19) of the bore (5) substantially in the central region thereof;

the two ports (A, B) for connection to a hydraulic apparatus being connected respectively, to two second recesses (21A, 21B) of the bore (5) situated on each side of the first recess (19);

the fluid return port connected to two third recesses ($T_1$, $T_2$) of the bore (5) situated respectively beyond said second recesses, with respect to the first recess;

said transverse channel (8) connected to two fourth recesses ($22_1$, $22_2$) of the bore (5) situated respectively towards the ends of said bore, beyond said third recesses, with respect to the first recess;

the spool (4) includes two annular zones of reduced diameter, situated approximately opposite the second recesses when the spool is in the neutral position;

the two end zones (28, 29) of the spool (4), situated beyond the two annular grooves respectively, being pierced respectively with two axial passages (34, 40) opening onto the lateral surface of the spool respectively through two radial passages (36, 42) situated approximately opposite the third recesses when the spool is in the neutral position;

at least one bore (33) in the spool valve body providing communication between one (34) of the end axial passages of the spool and the corresponding third recess ($T_1$) of the bore (5);

two radial passages (35, 41) formed respectively in the two end zones (28, 29) of the spool approximately opposite the fourth recesses ($22_1$, $22_2$) respectively, when the spool is in the neutral position;

and wherein the sliding spool (4) is of one of the two following types:

(a) in a first type of spool, the grooves of the spool have a bottom without flange, the spool valve ($D_1$) equipped with such a spool having three functional positions, namely direct (D), neutral (N) and reverse (M);

(b) in a second type of spool, one (26) of the grooves of the spool has a flange (44) situated approximately centrally and having peripherally the nominal diameter of the spool, the spool valve ($D_2$, $D_3$, $D_4$) equipped with such a spool having four functional positions, namely direct (D), neutral (N), reverse (M) and indeterminate (F);

whereby it is possible to form, with the above mentioned arrangements, two types of hydraulic spool valve having the same valve body.

2. The hydraulic spool valve according to claim 1, characterized in that the two connection ports (A, B) are situated on the same face (16) of the spool valve (of first main face) other than the two said bearing faces (2, 3) in the stack and other than the two end faces (5, 6) between which said bore (5) extends and the two corresponding ducts (20A, 20B) connecting the ports (A, B) with the second recesses (21A, 21B), respectively, extend in the position ($1_s$) of the body of the spool valve situated between said first main face (16) and the bore (5) and in that the intake port (P) and the corresponding ducts (13, 18) connecting this latter with said first recess (19) are situated in the portion ($1_i$) of the body of the spool valve situated between the bore (5) and the second main face (17) opposite said first main face (16).

3. Hydraulic spool valve according to claim 2, characterized in that, in the portion ($1_i$) of the body of the spool valve containing the intake port (P), a hydraulic balance arrangement is provided.

4. Hydraulic spool valve according to claim 3, characterized in that the hydraulic balance arrangement projects at least partially with respect to said second main face of the body of the spool valve.

5. Hydraulic spool valve according to claim 2, characterized in that one at least of the connection ports (A, B) is provided with a mechanically controlled non return valve.

6. Hydraulic spool valve according to claim 5 characterized in that a mechanically controlled non return valve and its control means are disposed in the portion of the spool valve body situated between the bore and the first main face of the spool valve body.

7. Hydraulic spool valve according to claim 5, characterized in that a hydraulically controlled non return valve and its control means are disposed in the portion of the spool valve body situated between the bore and the first main face of the spool valve body.

8. Hydraulic spool valve according to claim 2, characterized in that one at least of the connection ports (A, B) is provided with a hydraulically controlled non return valve.

* * * * *